US006389660B1

(12) United States Patent
Kataw

(10) Patent No.: US 6,389,660 B1
(45) Date of Patent: May 21, 2002

(54) SAFETY LOCK FOR JEWELRY

(76) Inventor: Kaled Kataw, 157 Highcrest Dr., West Milford, NJ (US) 07480

( * ) Notice: Subject to any disclaimer, the term of this patent is extended or adjusted under 35 U.S.C. 154(b) by 0 days.

(21) Appl. No.: 09/642,795

(22) Filed: Aug. 22, 2000

(51) Int. Cl.[7] ..... A44C 5/00
(52) U.S. Cl. ..... 24/614; 24/DIG. 52
(58) Field of Search ..... 24/614–616, 625

(56) References Cited

U.S. PATENT DOCUMENTS 2,094,228 A * 9/1937 Zook
4,619,022 A * 10/1986 Fontana
4,675,955 A * 6/1987 Nakamura
5,191,685 A * 3/1993 Aoki et al.
6,202,268 B1 * 3/2001 Goldstein et al.

* cited by examiner

*Primary Examiner*—James R. Brittain
(74) *Attorney, Agent, or Firm*—Alfred C. Hill

(57) ABSTRACT

A safety lock for jewelry having two free ends connected together by a selected clasp to prevent losing the jewelry should the selected clasp become disconnected comprising a fixed member having a predetermined configuration secured to and extending outwardly from one side of the jewelry adjacent one of the two free ends; and a pivotable member having one end thereof secured to the one side of the jewelry adjacent the other of the two free ends extending from the one side of the jewelry, the pivotable member having a length to span the selected clasp and to have the other end of the pivotable member engage the fixed member in a locked relationship to lock the two free ends together when the selected clasps disconnects.

9 Claims, 3 Drawing Sheets

SAFETY LOCK FOR JEWELRY

BACKGROUND OF THE INVENTION

The present invention relates to jewelry having two free ends connected together by a selected clasp and more particularly to a safety lock for such jewelry to prevent losing the jewelry if the selected clasp should become disconnected.

The disconnection could be accidental, or could be due to a failure of the clasp itself. As a result the wearer would experience a substantial loss particularly where jewels are present on the jewelry.

Jewelry items such as necklaces, bracelets, wrist watches and so on require some kind of a fastener in order to keep them secured to the person. The crux of the problem presented to the jewelry industry is how to make jewelry functionally competent without detracting from the overall appearance of the jewelry. In other words, jewelry clasps must abide by principles of both form and function. Clasps heretofore available often compromise function in the name of aesthetic appeal.

Among the important features a merchandisable jewelry clasp must have are (1) it must effectively hold together and not come unfastened while the jewelry is being worn, (2) it must be easy to manipulate between the open and close position and (3) jewelry clasps must be aesthetically pleasing and not detract from the overall appearance of the jewelry.

The clasp must effectively secure the piece to the person. The safety and security features the clasp offers are especially important. In this connection, the value of the pieces of jewelry often depends largely upon the safety the clasp provides. Clasps often fit loosely sometimes to the extent they come apart and the jewelry is lost or broken. Thus, the selection of jewelry may often times be depended upon its particular clasp.

Another problem is that operating the clasp must be easy and convenient. Fumbling to locate the proper notch or to operate a particular spring-loaded element is common among jewelry wearers. This is especially the case with small and even tiny clasps. Often these clasps require another persons assistance, thus becoming a troublesome job. In addition, tiny spring-loaded clasps are easy to break and they lose their elasticity.

Due to the use of the safety lock disclosed herein, it is possible to use any particular clasp that would join together the two free ends of the jewelry and yet provide safety if this clasp should become disconnected for any reason.

SUMMARY OF THE INVENTION

An object of the present invention is to provide a safety lock for jewelry having two free ends connected together by a selected clasp to prevent losing the jewelry should the selected clasp become disconnected.

Another object of the present invention is to provide a safety lock for jewelry as described above which is aesthetic and is easily moved from the latched condition to the unlatched condition.

Still a further object of the present invention is to provide a safety lock for jewelry of the above described type which has no longitudinal or transverse movement when in a latched or locked position.

A feature of the present invention is the provision of a safety lock for jewelry having two free ends connected together by a selected clasp to prevent losing the jewelry if the selected clasp should become disconnected comprising a fixed member having a predetermined configuration secured to and extending outwardly from one side of the jewelry adjacent one of the two free ends; and a pivotable member having one end thereof secured to the one side of the jewelry adjacent the other of the two free ends and extending parallel to the one side of the jewelry, the pivotable member having a length to span the selected clasp and to have the other end of the pivotable member engage the fixed member in a locked relationship to lock the two free ends together when the selected clasp disconnects.

BRIEF DESCRIPTION OF THE DRAWING

Above-mentioned and other features and objects of the present invention will become more apparent by reference to following description taken in conjunction with the accompanying drawing, in which.

DESCRIPTION OF THE PREFERRED EMBODIMENTS

Figure 1:
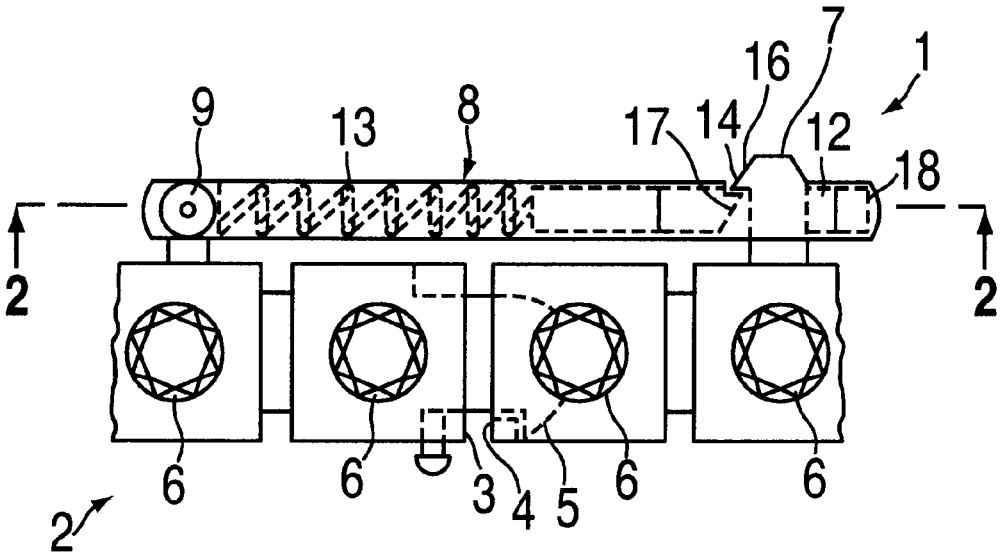
FIG. 1 is a side view of jewelry incorporating a first embodiment of the safety lock in accordance with the principles of the present invention in a locked position.

The illustrations of FIGS. 1–6 are enlarged for ease of viewing and it should be kept in mind that when present on jewelry would be much smaller and in fact could be quite tiny.

Referring to FIGS. 1–4, there is illustrating therein a first embodiment of the safety lock in accordance with the principles of the present inventions.

The safety lock 1 for jewelry 2 having two free ends 3 and 4 are connected together by a selected clasp 5 of the push lock type. The safety lock 1 prevents losing the jewelry 2 containing jewels 6 if the selected clasp 5 should become disconnected.

Figure 3:
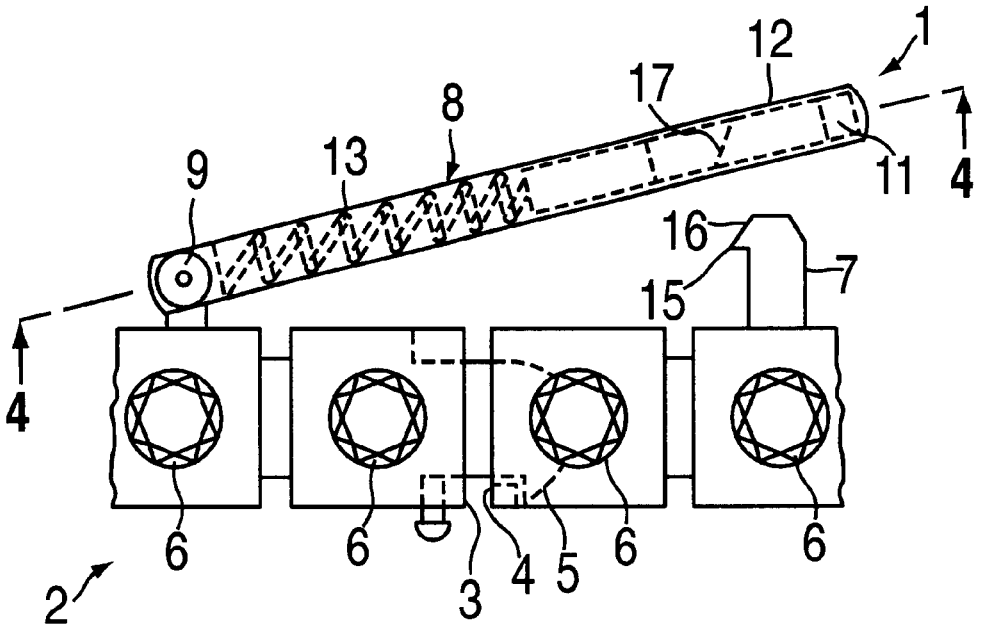
FIG. 3 is a side view of the jewelry and the safety lock of FIG. 1 in an unlocked position.

As illustrated in FIGS. 1–4, the safety lock includes a fixed member or stud 7 having a predetermined configuration secured to and extending outwardly from one side of jewelry 2 adjacent one of the two free ends, such as end 4 illustrated in FIGS. 1 and 3. The other element of the safety lock is pivotable member 8 having one end thereof secured to the one side of jewelry 2 adjacent the other of the two free ends, shown in FIGS. 1 and 3 as being adjacent end 3. The member 8 is pivotable on pivot 9 and member 8 extends parallel to the one side of jewelry 2. Member 8 has a length to span the clasp 5 and to have the other end thereof engage the fixed member 7 in a locked relationship as shown in FIG. 1.

Figure 2:
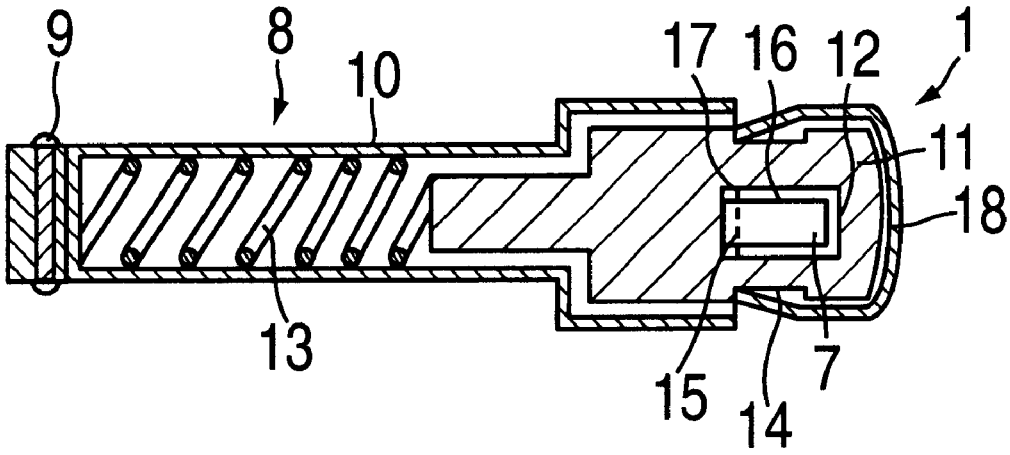
FIG. 2 is a cross-sectional view taken along line 2—2 of FIG. 1.
Figure 4:
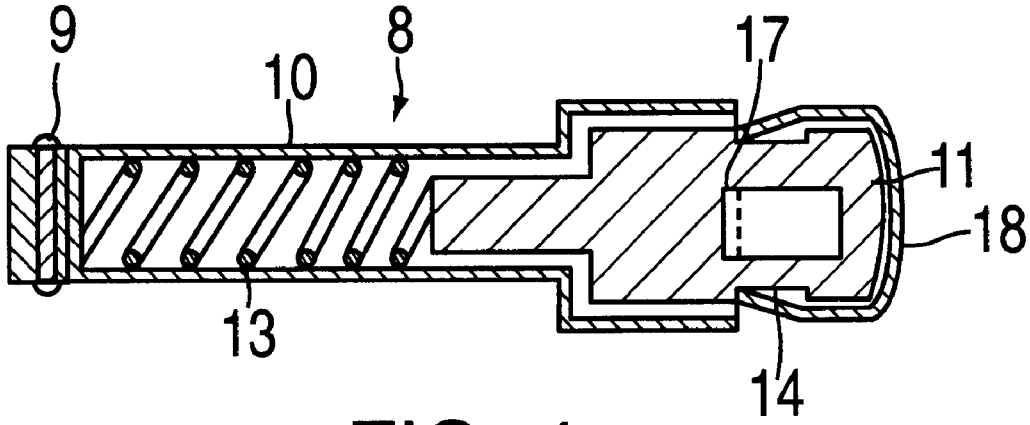
FIG. 4 is a cross-sectional view taken along line 4—4 of FIG. 3.

As shown in FIGS. 2 and 4, the member 8 includes a housing 10 pivotably secured at pivot 9 to one side of the jewelry 2. Housing 10 includes therein a movable member or insert 11 having an aperture 12 therein to receive the fixed member 7. A helical spring 13 is disposed between the one end of the housing 10 adjacent pivot 9 and member 11 to bias member 11 toward the fixed member 7 to ensure a locked relationship without transverse or longitudinal play in the locked relationship.

A notch 14 is provided in member 11 so that when spring 13 and member 11 are placed in the housing 10 the housing 10 is crimped as illustrated in FIGS. 2 and 4 to retain the string 13 and member 11 within the housing 10, but yet enable the movement of member 11 within the housing 10 to accomplish the locked and unlocked position of the safety lock.

When in the locked position, as illustrated in FIGS. 1 and 2, the fixed member 7 has a lip 15 that engages the surface of member 11 adjacent thereto to establish the locked relationship desired in the safety lock.

For ease of latching or locking the member 8 to member 7, member 7 has a sloping surface 16 which has the same or similar angular slope as the edge of the aperture 12 as shown by surface edge 17 in FIG. 1. These two surfaces ease the latching of member 8 to member 7.

As is obvious in FIGS. 1–4, the stud or fixed member 7 is rectangular in configuration as is the aperture 12 of the member 11 of the pivotable member 8. Just because the member 7 and the aperture 12 are shown to be rectangular, this is not to be a considered a restrictive limitation to the concept of the jewelry lock disclosed herein. Other configurations of member 7, aperture 12 and member 11 are possible to achieve the same end result of providing a safety lock in accordance with the principles of the present invention.

To unlock the safety lock in accordance with the principles of the present invention, the surface 18 which is protected by the housing 10 of the pivotable member 8 can be pushed inwardly against the force of the spring 13 to release the lip 15 from the edge of the aperture 12 to thereby enable unlocking of the lock. Pushing against the surface 18 can be accomplished by a fingernail of the wearer, or by placing a small instrument against surface 18. However, the fingernail is the most easy, convenient method of moving member 11. The protection of surface 18 by housing 10 overcomes a disadvantage of safety clasps on the market today which can accidentally get caught on clothes or other things depending on what the wearer of the jewelry is doing. It would be impossible for clothes or other things to catch on surface 18 and release the safety lock.

Figure 5:
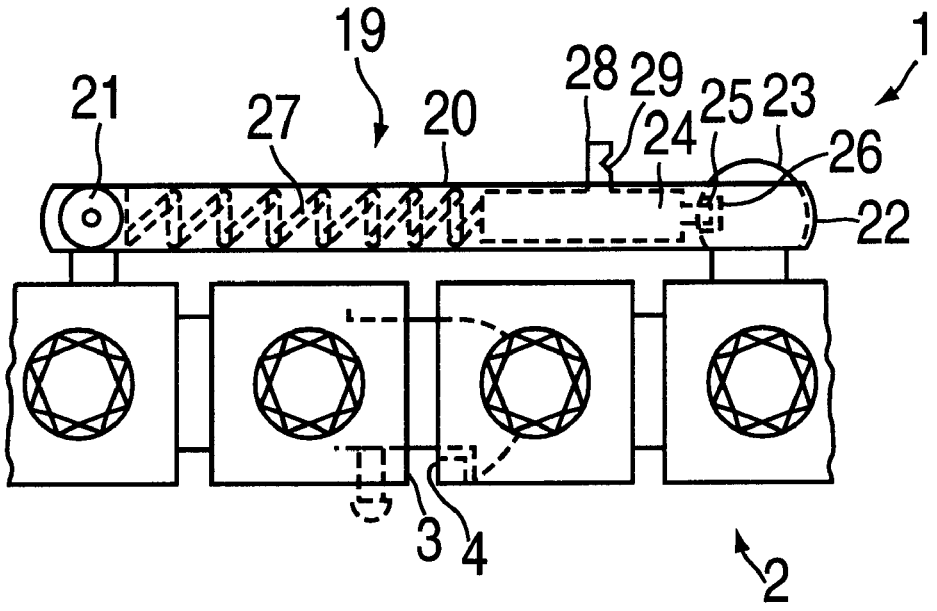
FIG. 5 is a side view of a second embodiment of the safety lock in conjunction with jewelry in the locked position in accordance with the principles of the present invention.
Figure 6:
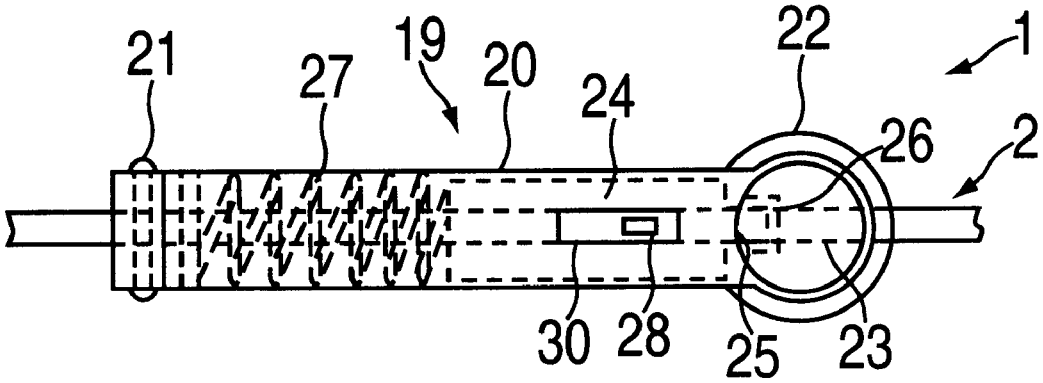
FIG. 6 is a top view of FIG. 5.

Referring to FIGS. 5 and 6, a second embodiment of the safety lock 1 in accordance with the principles of the present invention is illustrated. This embodiment of the safety lock 1 includes a pivotable member 19 again containing a housing 20 which is pivotable at pivot 21 connected to the jewelry adjacent one of the two free ends, such as end 3 in FIG. 5.

Housing 20 includes on the end thereof remote from pivot 21 a circular-like portion 22 that receives a fixed spherical-like member 23 fastened to the one side of jewelry 2 adjacent the other free end thereof, such as end 4 in FIG. 5. The housing 20 of pivotable member 19 includes therein a movable member 24 having an end portion 25 to engage a notch 26 in spherical-like fixed member 23. As in the first embodiment a helical spring 27 is bearing against member 24 to bias end portion 25 into notch 26 of member 23. As illustrated in FIG. 6 the circular-like portion 22 has hollow interior with the inner surface of portion 22 being in close proximity to member 23 to prevent any longitudinal or transverse movement of the safety lock.

The unlocking arrangement for this embodiment includes a lever 28 attached to member 24 to enable the use of a thumbnail or other instrument in the notch 29 to move the movable member 24 against the bias of spring 27 to thereby remove portion 25 from notch 26 of member 23 to thereby release the safety lock. Lever 28 extends through slot 30 of housing 20 and is movable therein to accommodate movement of member 24.

While I have described above the principles of my invention in connection with specific apparatus it is to be clearly understood that this description is made only by way of example and not as a limitation to the scope of my invention as set forth in the objects thereof and in the accompanying claims.

I claim:

1. A safety lock for jewelry having two free ends connected together by a selected clasp to prevent losing said Jewelry if said selected clasp should become disconnected comprising:

a fixed member having a predetermined configuration secured to and extending outward from one side of said jewelry adjacent one of said free ends;

a housing having one end thereof pivotally secured to said one side of said jewelry adjacent the other of said two free ends and extending parallel to said one side of said jewelry, said housing having a movable member disposed therein adjacent the other end of said housing having an aperture therein, said housing having a length to span said selected clasp and to have said aperture capable of engaging said fixed member to provide a locked relationship to lock said two free ends together when said selected clasp disconnects;

engaging means for said safety lock including a cooperative arrangement of said fixed member and said aperture to assist said aperture to engage said fixed member to provide said locked relationship;

a helical spring disposed between said one end of said housing and said movable member remote from said aperture to bias said movable member toward said fixed member to ensure said locked relationship; and unlocking means associated with said movable member remote from said helical spring contained completely within said housing operable by a user to disengage said aperture from said fixed member.

2. A safety lock according to claim 1, wherein said aperature is rectangular having a predetermined length in line with said helical spring and a predetermined width; and said fixed member is rectangular having a length slightly less than said predetermined length, a width slightly less than said predetermined width and a lip extending therefrom to engage a surface of said movable member remote from said one side of said jewelry and adjacent said helical spring to provide said locked relationship.

3. A safety lock according to claim 2, wherein said engaging means includes a first slanted surface on said fixed member adjacent said lip in line with said helical spring, and a second slanted surface on a wall of said aperture adjacent said lip in line with said helical spring having the same angle as said first slanted surface to assist in said aperture engaging said fixed member in said locked relationship.

4. A safety lock according to claim 3, wherein said unlocking means includes a surface of said movable member remote from said helical spring and adjacent said aperture within said housing, but exposed to said user's fingernail and the like to disengage said housing from said fixed member.

5. A safety lock according to claim 1, wherein said engaging means includes a first slanted surface on said fixed member in line with said helical spring, and a second slanted surface on a wall of said aperture in line with said helical spring adjacent said first slanted surface having the same angle as said first slanted surface to assist in said aperture engaging said fixed member in said locker relationship.

6. A safety lock according to claim 5, wherein said unlocking means includes a surface of said movable member remote from said helical spring and adjacent said aperture within said housing but exposed to said user's fingernail and the like to disengage said housing from said fixed member.

7. A safety lock according to claim 1, wherein said unlocking means includes a surface of said movable member remote from said helical spring and adjacent said aperture within said housing but exposed to said user's fingernail and the like to disengage said housing from said fixed member.

8. A safety lock for jewelry having two free ends connected together by a selected clasp to prevent losing said jewelry if said selected clasp should become disconnected comprising:

a fixed member having a predetermined configuration secured to and extending outward from one side of said jewelry adjacent one of said two free ends;

a housing having one end thereof pivotally secured to said one side of said jewelry adjacent the other of said two free ends and extending parallel to said one side of said jewelry, said housing having a movable member disposed therein adjacent other end of said housing, said housing having a length to span said selected clasp and an engaging means to engage said fixed member to provide a locked relationship, said engaging means and said fixed member having a configuration to reduce longitudinal and transverse movement therebetween when in said locked relationship; and an unlocking means including a surface of said movable member adjacent said other end of said housing within said housing but exposed to the user's fingernail and the like to disengage said housing from said fixed member.

9. A safety lock for jewelry having two free ends connected together by a selected clasp to prevent losing said jewelry if said selected clasp should become disconnected comprising:

a fixed member having a predetermined configuration secured to and extending outward from one side of said jewelry adjacent one of said two free ends;

a housing having one end thereof pivotally secured to said one side of said jewelry adjacent the other of said two free ends and extending parallel to said one side of said jewelry, said housing having a movable member disposed therein adjacent the other end of said housing, said housing having a length to span said selected clasp and an engaging means to engage said fixed member to provide a locked relationship, said engaging means and said fixed member having a configuration to reduce longitudinal and transverse movement therebetween when in said locked relationship;

a helical spring disposed within said housing between said one end of said housing and said movable member to bias said movable member toward said fixed member to ensure said locked relationship;

said fixed member being a sphere having a notch therein adjacent said movable member;

said other end of said housing being circular to encircle said sphere in a close fitting relationship;

said helical spring biasing said movable member to engage said notch of said sphere to provide said locked relationship; and a lever secured to said movable member and extending perpendicularly from said movable member through said housing in a slot therethrough to enable disengaging said movable member from said notch to unlock said locked relationship.

* * * * *